US005218374A

United States Patent [19]

Koert et al.

[11] Patent Number: 5,218,374

[45] Date of Patent: Jun. 8, 1993

[54] POWER BEAMING SYSTEM WITH PRINTER CIRCUIT RADIATING ELEMENTS HAVING RESONATING CAVITIES

[75] Inventors: Peter Koert, Washington, D.C.; James T. Cha, Fairfax, Va.

[73] Assignee: APTI, Inc., Washington, D.C.

[21] Appl. No.: 419,144

[22] Filed: Oct. 10, 1989

Related U.S. Application Data

[63] Continuation-in-part of Ser. No. 239,289, Sep. 1, 1988, Pat. No. 5,068,669.

[51] Int. Cl.[5] ..... H01Q 1/280; H01Q 9/160; H01Q 13/080

[52] U.S. Cl. ..... 343/789; 343/795; 343/DIG. 2

[58] Field of Search ..... 343/700 MS File, 769, 343/778, 789, 793, 795, 797, 846; 307/151; 361/395; 333/230, 250

[56] References Cited

U.S. PATENT DOCUMENTS

| | | | |
|---|---|---|---|
| 3,434,678 | 3/1969 | Brown et al. | 244/1 |
| 3,542,316 | 11/1970 | Hart | 244/17.11 |
| 3,989,994 | 11/1976 | Brown | 343/771 |
| 4,079,268 | 3/1978 | Fletcher et al. | 343/700 MS |
| 4,218,685 | 8/1980 | Ellis, Jr. | 343/789 |
| 4,259,743 | 3/1981 | Kaneko et al. | 333/250 |
| 4,360,741 | 11/1982 | Fitzsimmons et al. | 307/151 |
| 4,527,165 | 7/1985 | de Ronde | 343/778 |
| 4,685,047 | 8/1987 | Phillips, Sr. | 307/151 |
| 4,697,761 | 10/1987 | Long | 244/62 |
| 4,752,730 | 6/1988 | Aslan | 343/703 |
| 4,758,843 | 7/1988 | Agrawal et al. | 343/700 MS |
| 4,792,810 | 12/1988 | Fukuzawa et al. | 343/700 MS |
| 4,853,705 | 8/1989 | Landt | 343/803 |
| 4,878,060 | 10/1989 | Barbier et al. | 343/778 |
| 4,888,597 | 12/1989 | Rebiez et al. | 343/778 |

FOREIGN PATENT DOCUMENTS 0071069 2/1983 European Pat. Off. ..... 343/700 MS

OTHER PUBLICATIONS

Brown et al., Experimental Thin Film, Etched Circuit Rectenna 1982 IEEE MTT-S Digest.

"Rectenna Technology Program: Ultra Light 2.45 GHz Rectenna and 20 GHz Rectenna", William C. Brown, Raytheon Company, NASA Report No. CR179558, Mar. 11, 1987.

"Synchotron Radiation Coversion by Recttennas for ARIES-II" by John Santarius, dated Aug. 22, 1989.

"Millimeter-Wave/Infrared Rectenna Development at Georgia Tech", by Mark A. Gouker, Power Beaming Workshop, Apr. 1988.

"The History of Power Transmission by Radio Waves", William C. Brown IEEE Transactions on Microwave Theory and Techniques, vol. MTT-32, No. 9, Sep. 1984.

"A Microwave Powered High Altitude Platform", Schlasak et al, IEEE MTT-S Digest, pp. 283-286, 1988.

"Introduction to Gyro Devices":, Varian, Publication No. 4762 Nov. 1984.

"Very High Power mm-Wave Components in Oversized Waveguides", by Thumm et al, Microwave Journal, Nov. 1986.

*Primary Examiner*—Rolf Hille
*Assistant Examiner*—Peter Toby Brown
*Attorney, Agent, or Firm*—Foley & Lardner

[57] ABSTRACT

A system and method for "power beaming" energy from a source at high frequencies and rectifying such energy to provide a source of DC energy is disclosed. The system operates at a frequency of at least 10 GHz and incorporates a rectenna array having a plurality of rectenna structures that utilize circuit elements formed with microstrip circuit techniques. Each rectenna element is associated with a resonating cavity structure.

16 Claims, 12 Drawing Sheets

POWER BEAMING SYSTEM WITH PRINTER CIRCUIT RADIATING ELEMENTS HAVING RESONATING CAVITIES

CROSS-REFERENCE TO RELATED APPLICATIONS

This is a continuation-in-part of U.S. Ser. No. 07/239,284 now U.S. Pat. No. 5,068,669 entitled "Power Beaming System" by Koert et al., filed Sep. 1, 1988, and claims priority therefrom.

BACKGROUND OF THE INVENTION

The present invention relates in general to the transfer of energy by means of electromagnetic waves to power a remote device. More specifically, the present invention relates to a system for "power beaming" energy from a source at high frequencies and rectifying such energy to provide a source of DC energy to a remote device.

Attempts have been made for many years to develop a system for beaming energy from a source to power a remote device with a high degree of efficiency (for a general discussion see "The History of Power Transmission by Radio Waves" by William C. Brown, IEEE Transactions on Microwave Theory and Techniques, Vol. MTT-32, No. 9, September 1984). In particular, the concept of powering a satellite or free flying aircraft by power beaming has received a great deal of attention. The advantages of such a system are readily apparent, for example, an aircraft could be maintained on station indefinitely to act as a low cost communications or reconnaissance platform. Early concepts included the conversion of microwave energy into thermal energy to power a helicopter type platform as illustrated in U.S. Pat. No. 4,542,316 issued to Hart. A more practical approach, however, has focused on converting the microwave energy into DC energy to directly power the platform.

The practical conversion of microwave energy to DC energy for power beaming purposes has been based on the use of rectennas to receive and rectify the microwave energy. Generally, rectennas are limited in their power-handling capabilities, but can be a highly efficient means of converting microwave energy into DC energy for power beaming purposes when employed in large numbers in an array structure. U.S. Pat. No. 3,434,678 issued to Brown et al. illustrates the use of a rectenna array to power a helicopter platform by power beaming.

More recently, a scale model of a long endurance high altitude platform powered by microwave energy known as SHARP (Stationary High Altitude Relay Platform) has been successfully demonstrated. See "A Microwave Powered High Altitude Platform" by Schlesak et al., 1988 IEEE MTT-S Digest, pp. 283–286. The SHARP concept calls for an array of ground antennas which must be focused on the aircraft. The underside of the aircraft would be coated with a thin-film array of thousands of half-wave dipole rectennas to convert the received microwave energy into DC energy which would be used to power the aircraft's electrical motor.

The scale model of the SHARP aircraft was powered by a microwave beam formed form the outputs of two 5 kW continuous-wave magnetrons, which were combined and supplied to a 4.5 meter diameter parabolic antenna to transmit 10 kilowatts of energy at a frequency of 2.45 GHz. Dual polarization rectennas formed of two orthogonal linearly-polarized rectenna arrays were provided on the model aircraft to convert the microwave energy to DC power.

Efforts at power beaming to date, like SHARP discussed above, have focused primarily on using S-band transmission sources due to their ready availability and to reduce power losses due to atmospheric attenuation. S-band power beaming, however, is limited in the amount of power that can be delivered in a practical system. In order to generate sufficient power densities, a large array of ground antennas must be employed which complicates the problem of concentrating the transmitted energy on the aircraft. One could reduce the number of ground antennas employed in the array, but the size of the antennas would increase significantly making them as difficult to track as the array while greatly increasing their expense. In addition, S-band power beaming requires a large amount of surface area for the rectenna array on the aircraft to generate significant power quantities. For example, the SHARP system discussed above would need an array of 100 $m^2$ of rectenna surface of generate only 35 kW of DC power, 25 kW of which is required to power the propulsion system, wile requiring a transmitter having a diameter of 85 meters with an output of 500 kW.

SUMMARY OF THE INVENTION

The present invention departs from the prior art by providing a power beaming system that operates at a much higher frequency, on the order of tens of GHz or greater, to thereby provide a system having a power density an order in magnitude greater than conventional power beaming systems while at the same time having the advantage of a smaller transmission source and rectenna array.

More specifically, the present invention provides a power beaming system including a power transmission source capable of generating electromagnetic radiation having a preferred frequency of at least 10 Gigahertz, a transmission antenna mounted on a movable pedestal, a guide unit that guides the electromagnetic radiation generated by the power transmission source to the transmission antenna and a rectenna array located at a position remote from the antenna structure.

BRIEF DESCRIPTION OF THE DRAWINGS

A preferred exemplary embodiment will hereinafter be described in conjunction with the appended drawings wherein like designations denote like elements, and wherein.

DETAILED DESCRIPTION OF THE PREFERRED EMBODIMENTS

Figure 1:
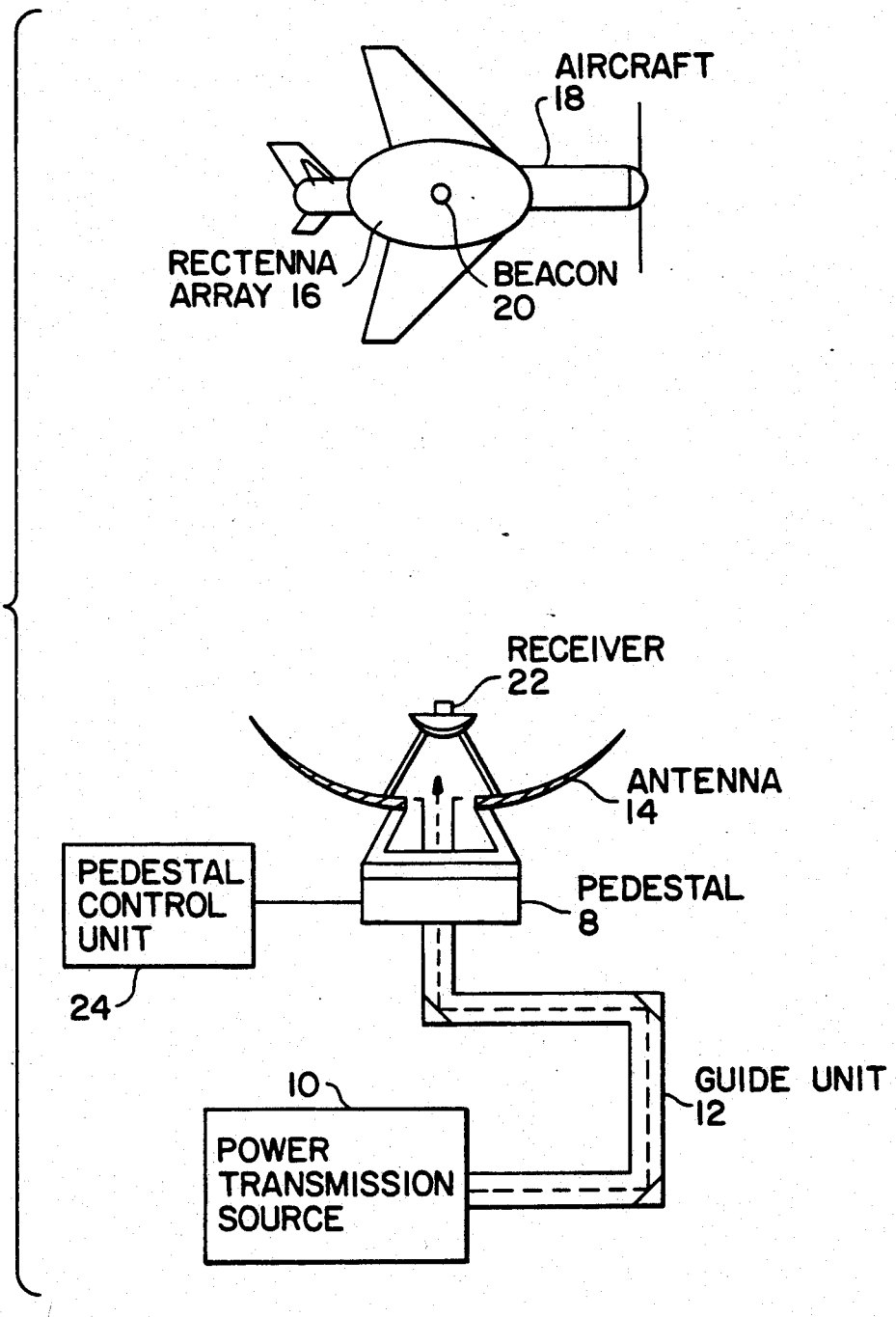
FIG. 1 is an overall system diagram of a power beaming system according to the present invention.

Referring now to FIG. 1, a power beaming system according to the present invention is illustrated having a power transmission source 10 operating at a preferred frequency of at least 10 GHz, and more preferably of at least 18 Ghz, that feeds energy to an antenna 14 via a guide unit 12. The antenna 14 is mounted to a movable precision pedestal 8 that is controlled by a pedestal control unit 24. The energy generated by the power transmission source 10 is focused into a beam by the antenna 14 to illuminate a preferable circular rectenna array 16 affixed to the bottom of an electrically powered aircraft 18. The rectenna array 16 converts the energy received from the antenna 14 to DC energy which is used to directly drive the electrical motor of the aircraft 18. The aircraft 18 in a preferred embodiment operates at an altitude of 21 kilometers.

In order to aid in tracking the antenna 14 to the movements of the aircraft 18, a directional beacon 20 is fixed to the center of the rectenna array 16. The directional beacon 20, preferably operating in the X-band frequency range, emits a tracking signal that is received by a receiver 22 located on the antenna 14. The output signal from the receiver 22 is used by a pedestal control unit 24 to control the tracking movements of the antenna 14 and insure that the energy beam generated by the system is centered on the rectenna array 16.

Figure 2:
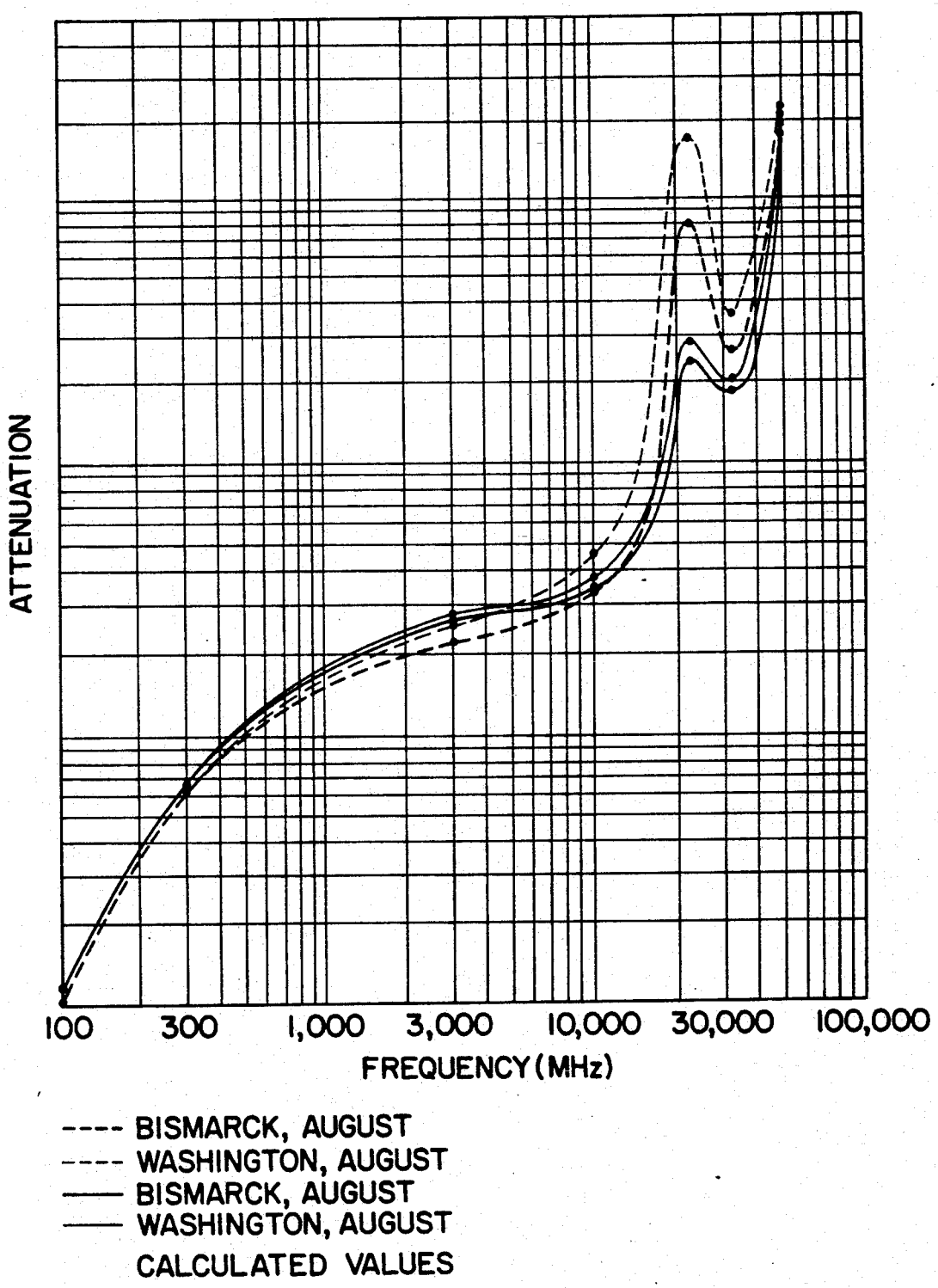
FIG. 2 is a graph illustrating atmospheric attenuation of electromagnetic waves at various frequencies.

As previously mentioned, one of the reasons conventional systems have been limited to S-band power beaming is to reduce power losses due to atmospheric attenuation of the transmitted beam. Generally, attenuation increases as operating frequency increases as illustrated by the chart shown in FIG. 2 (see "Radar Handbook" by M. I. Skolnik, McGraw-Hill Book Company, NY 1970, p. 24–26). At around 35 GHz., however, atmospheric attenuation drops off. Thus, a power beaming system operating in the range of about 28–44 GHz and preferably around 35 GHz, provides the advantages associated operating at higher transmission frequencies, such as the reduction in size of the ground antenna and the rectenna array while operating at higher power densities, with without experiencing an exponential growth in attenuation as frequency is increased.

In order to generate sufficient power densities at the desired frequency, one or more gyrotrons are preferably used for the power transmission source 10. The term "gyrotron" will be used throughout this specification to generically describe microwave oscillators based on the interaction of electrons orbiting in a DC magnetic field under the conditions of cyclotron resonance where the magnitude of the DC magnetic field and the microwave frequency are specifically related. Typically gyrotrons include single-cavity oscillators wherein the entire interaction takes place in a single microwave cavity, but it will be understood that the same basic interaction can be used with varying devices, such as amplifiers using several resonant cavities, which may sometimes be referred to as gyroklystrons, gyro TWTs or even cyclotron resonance masers, and that the term gyrotron is intended to cover all such devices. A more detailed explanation of gyrotrons is provided in the paper "Introduction to Gyro Devices", VARIAN publication number 4762, 11/84, incorporated herein by reference. Gyrotrons producing power outputs between 200–300 kW at frequencies of 28 Ghz to 60 GHz are presently available, and the outputs of one or more gyrotrons can be combined to obtain desired power output levels for the power transmission source 10. VARIAN has also demonstrated gyrotrons operating at 94 GHz, 110 GHz and 140 GHz with respective power outputs of 100 kW CW, 500 kW pulsed and 400 kW that could also be employed for the power transmission source 10.

Gyrotrons generally produce $TE_{On}$ modes which produce a hollow conical radiation pattern with zero power along the waveguide axis. When using a gyrotron for the power transmission source 10, however, it is desirable to perform a mode conversion operation in order to generate a narrow beam with a well-defined polarization. Accordingly, the guide unit 12 is constructed to perform the desired mode conversion. Mode converter assemblies for use in the guide unit 12 may be constructed out of waveguide assemblies as illustrated in the paper entitled, "Very High Power mm-Wave Components in Oversized Waveguides" by Thumm et al., Microwave Journal, November 1986, incorporated herein by reference, to produce a beam having the desired characteristics. Alternatively, beam waveguides could be employed for the guide unit 12 as described in the article entitled "Some Aspects of Beam Waveguide Design" by Chan et al., IEEE Proceedings, Vol. 129, Pt H, No. 4, August 1982, incorporated herein by reference.

Figure 3A:
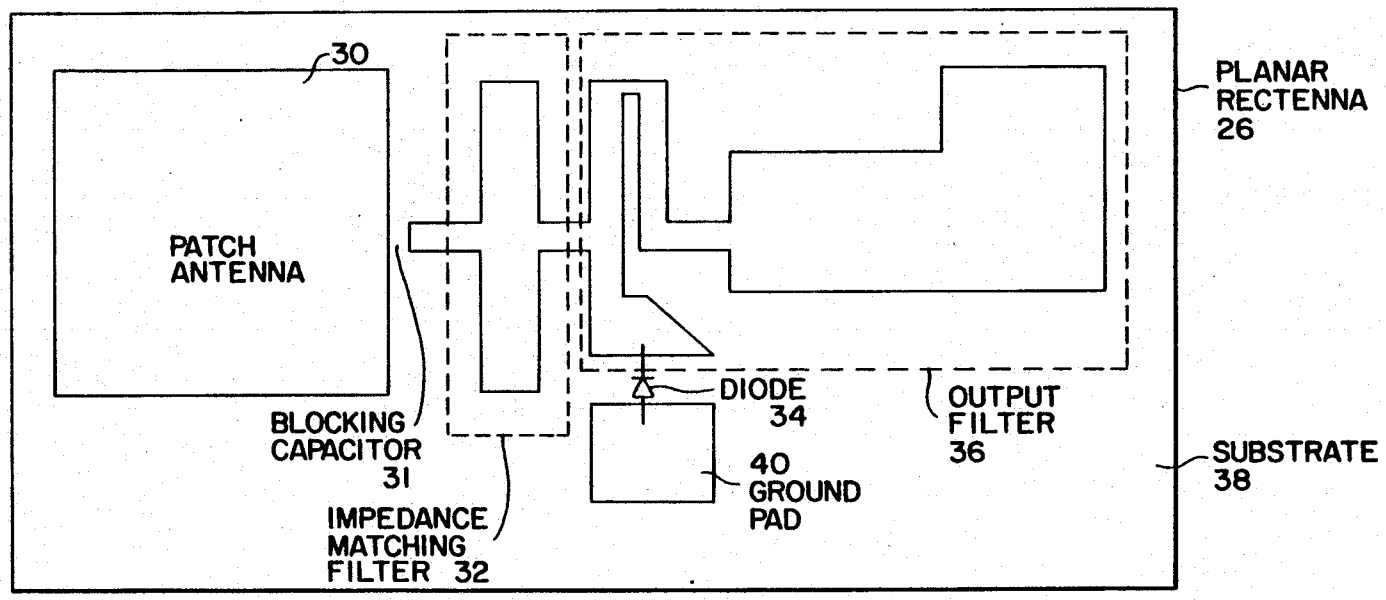
FIG. 3*a* illustrates a planar rectenna structure that may be incorporated in the system illustrated in FIG. 1.

Referring now to FIG. 3*a*, a planar rectenna 26 that may be employed in the rectenna array of the present system is shown having a patch antenna 30 which acts as a ½ wave resonator, an impedance matching filter 32, coupled to the patch antenna 30 by a blocking capacitance 31, for matching the impedance of the patch antenna 30 to a diode 34 (for example, ALPHA DMK6606), and an output filter 36.

The impedance matching filter 32 and output filter 36 of the planar rectenna 26 are formed using microstrip circuitry techniques on a dielectric substrate 38 (for example RT-DUROID manufactured by Rogers Corporation, dielectric constant 2.2) of the planar rectenna 26. Microstrip circuitry provides a simple and economical method of providing the circuit elements of the impedance matching filter 32 and output filter 36 in a compact structure, and permits the diode 34 to be located as close as possible to the patch antenna thereby avoiding losses due to lengthy interconnect lines. For example, the components of the impedance matching circuit 32 and the output filter 36 are formed by conventional copper etching techniques on a top surface of the dielectric substrate 38. A ground pad 40 is also provided to provide electrical connection via plated through holes to a ground plane (not shown) provided beneath the dielectric substrate 38.

The patch antenna 30 provides the advantage of dual polarization in a very simple structure without necessitating the overlapping of two linearly-polarized antenna layers. Other antenna structures may be employed; however, an antenna which is independent of the polarization of the incoming electromagnetic radiation is preferred.

Figure 3B:
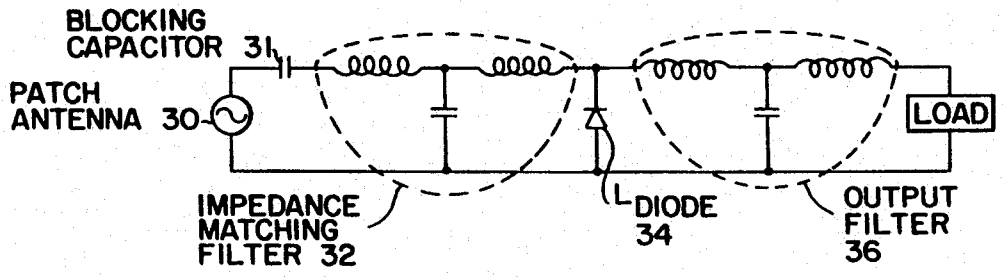
FIG. 3*b* is a circuit diagram of the planar rectenna array shown in FIG. 3*a;*
Figure 4A:
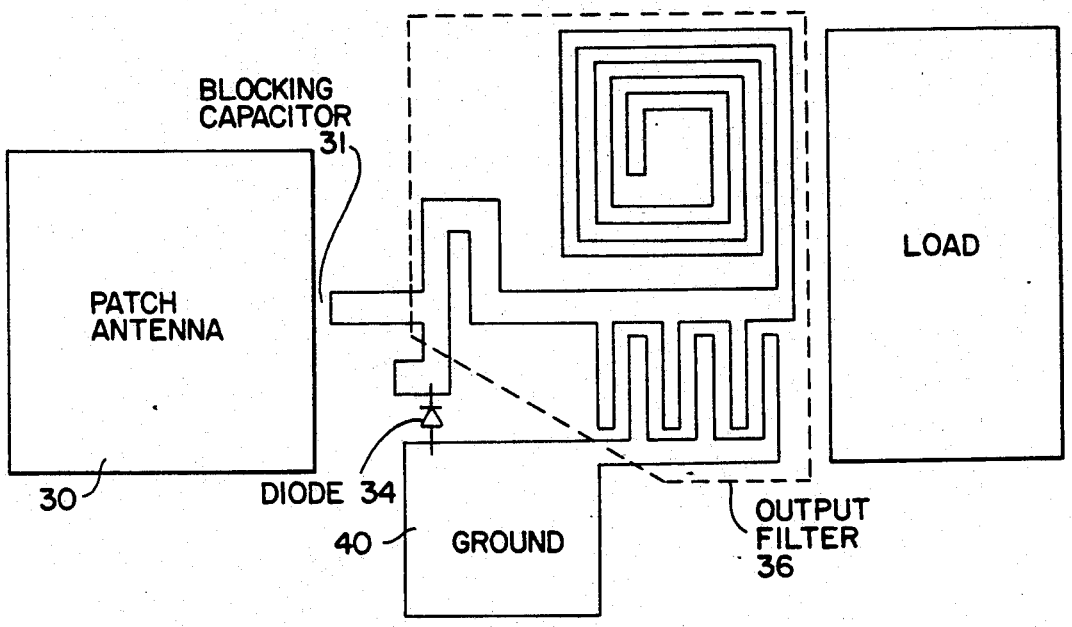
FIG. 4*a* illustrates a second planar rectenna structure that may be incorporated in the system illustrated, in FIG. 1.
Figure 4B:
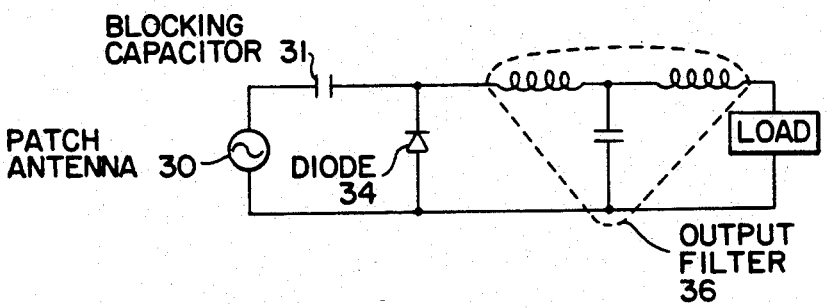
FIG. 4*b* is a circuit diagram of the planar rectenna illustrated in FIG. 4*a;*

A circuit diagram of the planar rectenna 26 is provided in FIG. 3*b*. Configurations and circuit arrangements other than those illustrated in FIGS. 3*a* and 3*b* are of course possible. For example, a second planar rectenna structure is illustrated in FIG. 4*a* which does not utilize an impedance matching filter. The circuit diagram for this planar rectenna structure is shown in FIG. 4*b*. The impedance matching filter is desirable, however, to optimize the output of the rectenna.

While the above described rectenna structure has been demonstrated to operate effectively in the frequency range of interest, it has a disadvantage in that the impedance matching and output filters take up a large percentage of the surface area of the substrate which limits the power conversion efficiency of the rectenna array. In other words, the rectenna array provides maximum efficiency when the maximum number of antennas can be provided on the surface area of the array. This problem can be addressed by providing a multi-layer rectenna structure, as opposed to the planar rectenna illustrated in FIG. 3*a*, in which the antenna is located on the surface of the substrate and the circuit elements, i.e., the impedance matching and output filters and the diode, are located in a separate layer beneath the antenna to provide a compact structure.

Figure 5A:
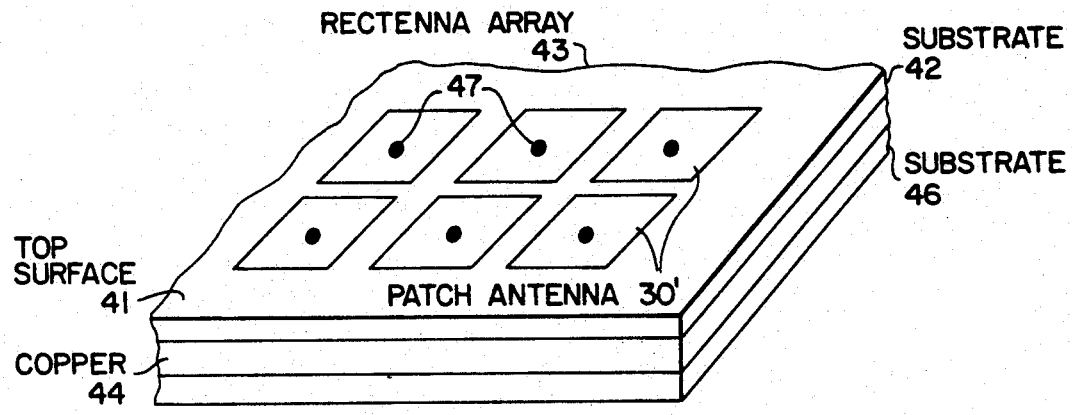
FIGS. 5*a* and 5*b* illustrate top and bottom surfaces, respectively, of a multi-layer rectenna structure that may be incorporated in the system illustrated in FIG. 1.
Figure 5B:
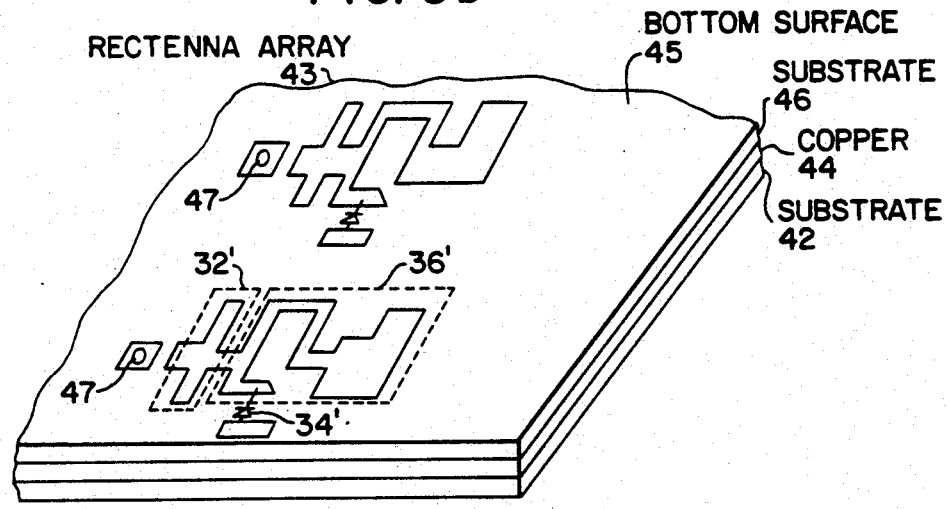

Referring now to FIG. 5*a*, a top surface 41 of a rectenna array 43 incorporating multi-layer rectennas is shown having a first substrate 42 on which a patch antenna 30' of each multi-layer rectenna is provided, a copper ground plane 44, and a second substrate 46 on which the circuit elements, i.e., the impedance matching filter 32', diode 34' and output filter 36', are provided as shown in FIG. 5*b*. The patch antennas 30' are coupled to the impedance matching filter 32' on the bottom surface 45 of the rectenna array 43 via plated-through holes 47. Thus, the patch antennas 30' may be readily spaced in the rectenna array (in this case ½ wavelength center to center) to provide maximum power conversion efficiency while maintaining a rectenna structure that may be easily fabricated using multi-layer circuit board fabrication techniques. It will be readily understood that in an array structure one output filter may be provided for a plurality of rectennas instead of providing each rectenna with its own output filter, and that the circuit elements may be provided on the inside surface of the substrate 46 if an insulating layer is positioned between the circuit elements and the ground plane 44.

Figure 6:
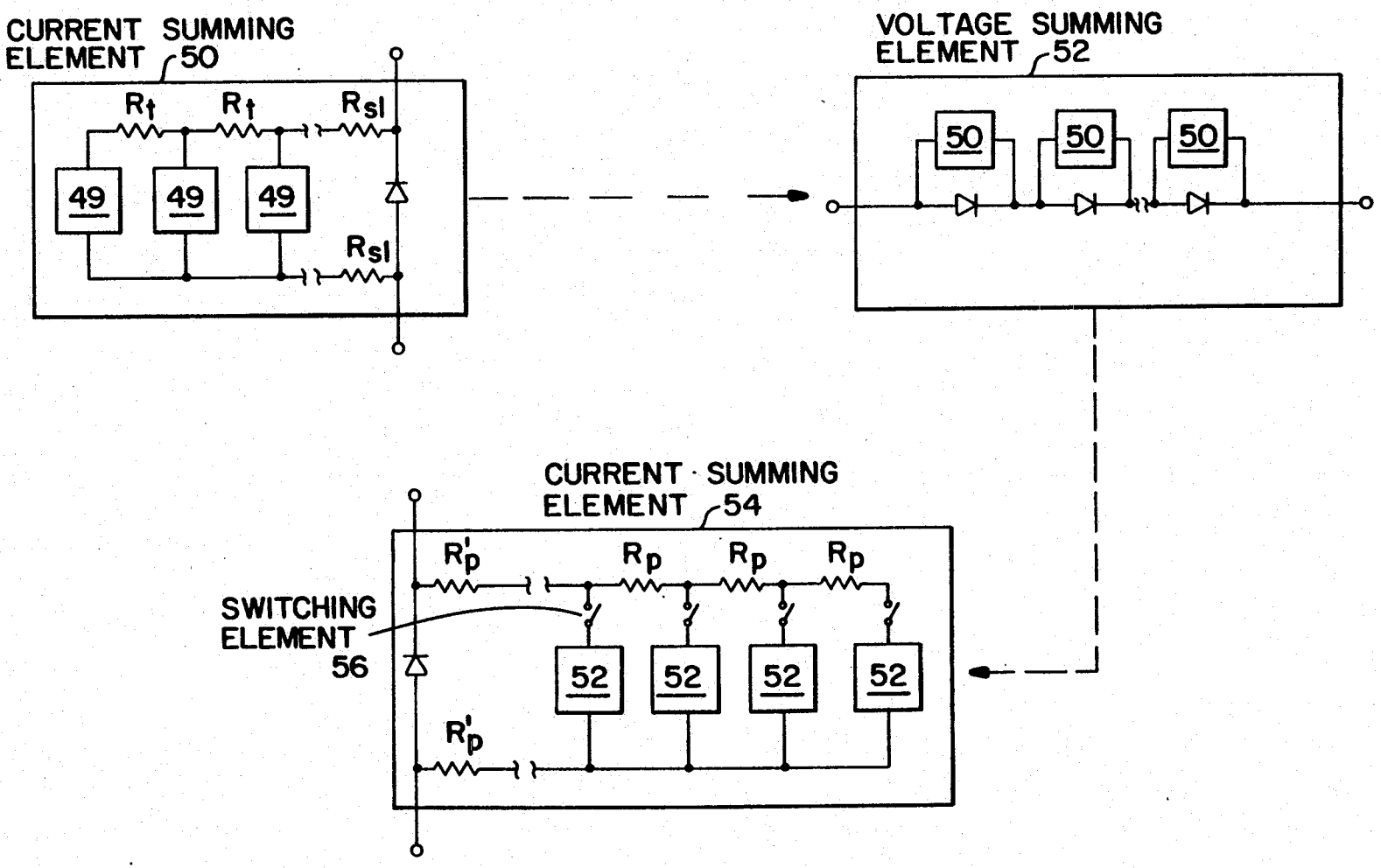
FIGS. 6 illustrates various components of a power combining network.

It is of course necessary to combine the outputs from each of the individual rectennas in the array 43 to provide useful voltage and current levels. FIG. 6 illustrates a power combining network which can be used to match the voltage and current output of the rectenna array to any desired load. In addition, the power combining network prevents the failure of one or more rectennas from seriously effecting the output of the entire array by providing a plurality of current and voltage summing elements.

As shown in FIG. 6, a current summing element 50 is formed by combining the output of several individual rectennas 49 in parallel. The resistance $R_t$ represents the resistance associated with the interconnect lines between the individual rectennas. Discrete resistors $R_{sl}$, having a value much greater than $R_t$, couple the rectennas to a diode $D_{dc}$. The current summing elements may then be combined in series to form a voltage summing element 52. Individual voltage summing elements 52 can then be combined to form additional current summing elements 54. Switching elements 56 are also provided so that the various current and voltage summing elements can be combined in any desired pattern to match the voltage and current requirements of the load.

Figure 7A:
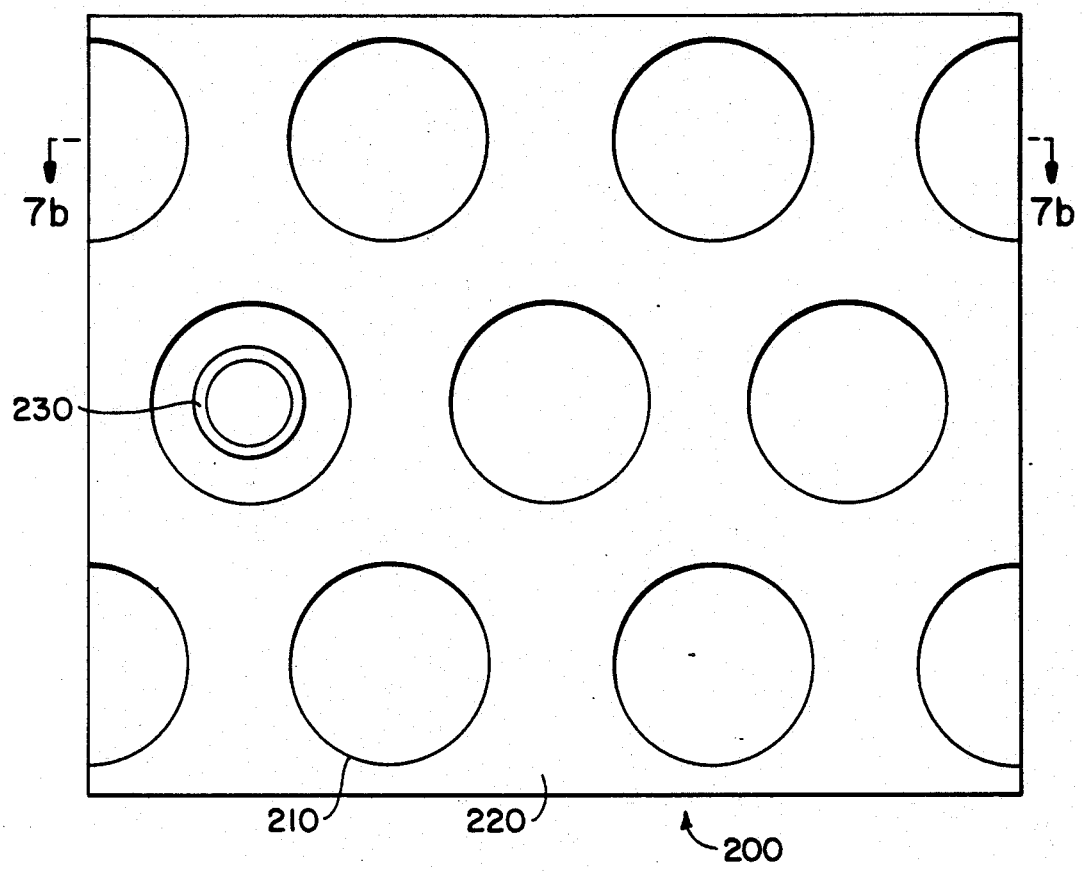
FIG. 7A is a top view of third rectenna structure that can be incorporated in the system illustrated in FIG. 1.
Figure 7B:
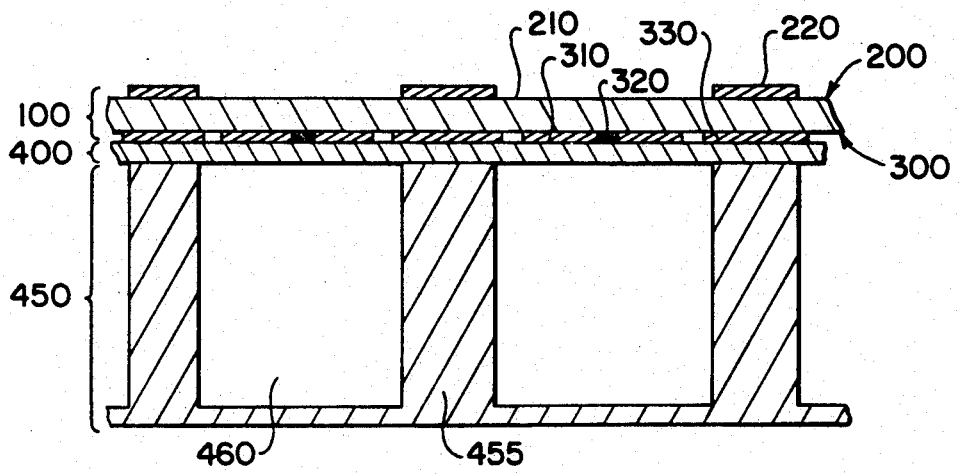
FIG. 7B is a cut away view of the rectenna structure illustrated in FIG. 7A.

A third type of rectenna array is illustrated in FIGS. 7A–7B. This alternative rectenna array offers the advantages of lower conductor loss due to placement of the diode in close proximity to the antenna, reduced weight, and simplicity of eliminating feedthrough links between layers. The illustrated rectenna structure is readily adaptable from 1 GHz to 300 GHz or more depending on the dimensions of the components.

Referring to FIG. 7B, the rectenna array is composed of multiple rectenna elements which include a top layer 100 (for example RT/Duroid 5880), an insulating layer 400, and a resonating cavity structure 450. The top layer 100 contains a top surface 200 and a bottom surface 300 on which a conductive coating, such as a metal film is deposited. The conductive coating, or metal film 220 deposited on the top surface 200 has a hole 210 (preferably formed by etching) which permits radiation to pass to an antenna 310 formed from the conductive coating or metal film deposited on the bottom surface 300. Deposited on the antenna 310 is a diode 320 that converts RF energy directly into DC energy. Connected to the antenna 310 is a feed line 300 which also forms a DC bus and low pass filters (also formed from the conductive coating deposited on the bottom surface 300).

The resonating cavity structure 450 includes a substrate 455 containing holes, or resonator cavities 460 formed therein. The cavity substrate 455 can be formed either from a solid conductive material, such as aluminum, in which the resonator cavities 460 are drilled as shown in FIG. 7B, or from a light weight conductive coated material, such as a metal coated foam, in which the resonator cavities 460 are drilled or molded. The insulating layer 400 is provided between the resonating cavity structure 450 and the feed lines 330 to prevent grounding.

Figure 7C:
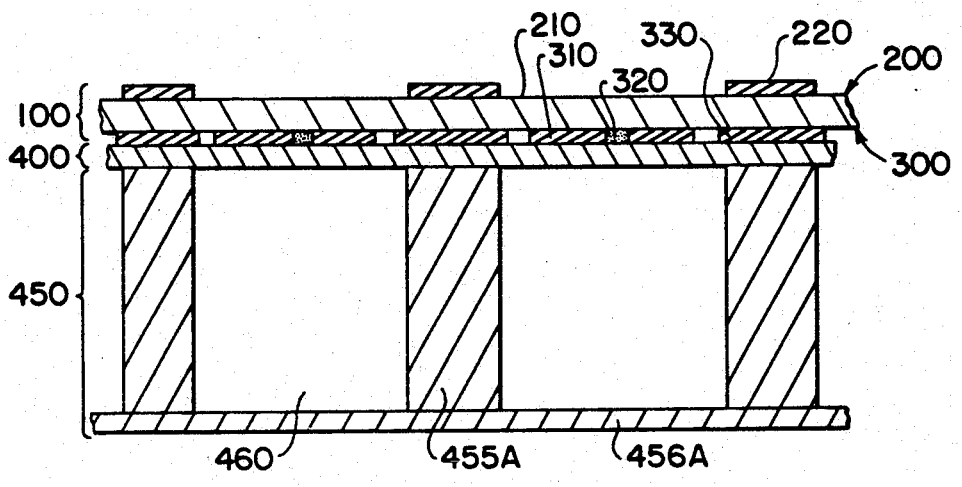
FIG. 7C is an alternative configuration for FIG. 7B with the cavity substrate divided into two parts for ease of fabrication.
Figure 7D:
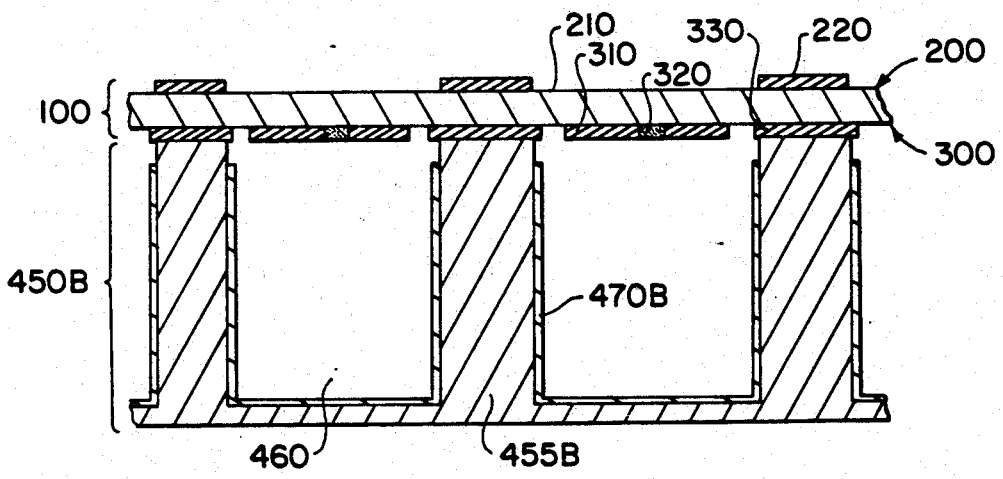
FIG. 7D is an alternative configuration for FIG. 7B with the resonating cavity structure extended to eliminate the insulating layer.
Figure 7E:
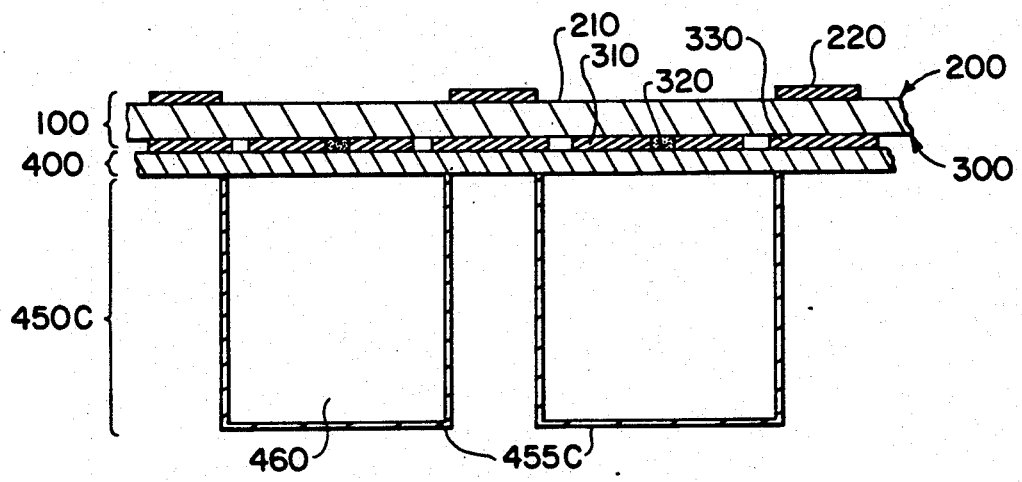
FIG. 7E is an alternative configuration for FIG. 7B used for ease of manufacturing at low frequencies.

FIGS. 7C through 7E illustrate alternate configurations for the rectenna array shown in FIG. 7B. FIG. 7C shows the cavity substrate 455 of FIG. 7B separated into two layers, a cavity substrate top 455A and a cavity substrate bottom 456A. Using two layers makes fabrication simpler since drilling holes to precise depths and shapes is more difficult than drilling completely through the cavity substrate top 455A and attaching a separate cavity substrate bottom 456A. FIG. 7D shows a method of eliminating the insulating layer 400 from FIG. 7B. In FIG. 7D, the resonating cavity structure 450 of FIG. 7B. is replaced with an extended resonating cavity structure 450B. The extended resonating cavity structure 450B has an extended cavity substrate 455B made of a lightweight material with a conductive coating 470B deposited, but the conductive coating 470B does not extend quite to the top of the resonator cavity 460. Since the metal does not extend to the top of the resonator cavity 460, circuitry on top layer 100 will not be grounded out. In FIG. 7E, the resonating cavity structure 450 of FIG. 7B is replaced with a low frequency resonating cavity structure 450C. The low frequency resonating cavity structure 450C includes individual canisters 455C instead of a single cavity substrate 455 shown in FIG. 7B. The individual canisters make manufacturing easier at low frequencies since sizes are substantially increased.

The holes 210 in the conductive coating 220 are illustrated in FIG. 7A. A tuning or resonate element 230 can be formed within the hole 210 if desired, in order to more efficiently couple the incoming RF energy into the antenna 310 located beneath the hole 210 to increase the gain of the rectenna element. The tuning or resonate element 230 can be formed as a ring as shown in FIG. 7A or it may take the shape of a bar or series of dots. The tuning or resonate element 230 is a metal film and is formed by etching the top surface 200 with holes as described on page 13.

Figure 8A:
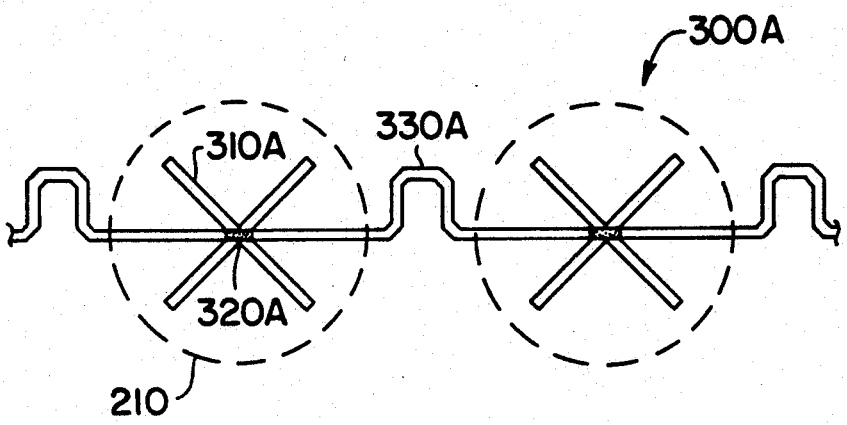
FIG. 8A illustrates an antenna structure that can be employed in the rectenna illustrated in FIG. 7A which uses cross dipole antennas to receive circularly polarized RF energy.
Figure 8B:
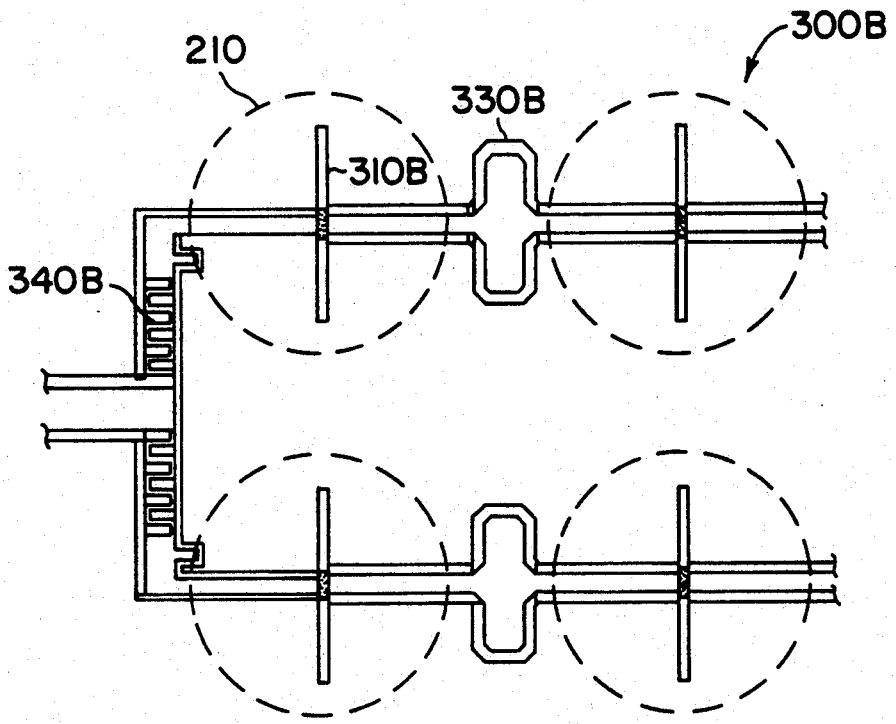
FIG. 8B illustrates another antenna structure that can be employed in the rectenna illustrated in FIG. 7A which uses single dipole antennas to receive linearly polarized RF energy.

FIGS. 8A and 8B show various configurations of the antennas 310 formed on the bottom surface 300 of the top layer 100. In FIG. 8A, the antenna 310 is composed of a cross dipole antenna 310A which is used to receive incident circularly polarized RF energy. A diode 320A (for example Alpha DMK 2606 Schottky diode) is deposited on the dipoles 310A to directly convert RF to DC energy. Line 330A is a varying impedance line to form both a feed line serving as a DC bus and low pass filter. FIG. 8B illustrates a second configuration that uses a single dipole antenna 310B to receive incident linearly polarized RF energy. In this embodiment, feed lines 330B serve only as a DC bus which channels RF energy to a central low pass filter unit 340B.

Figure 9A:
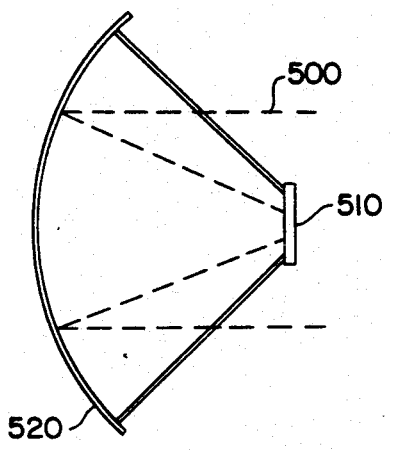
FIG. 9A shows use of a parabolic reflector to focus incident RF energy onto a rectenna.
Figure 9B:
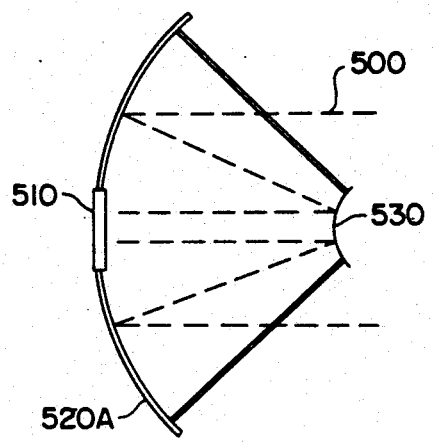
FIG. 9B shows a cassegrain combination of a parabolic reflector and a subreflector to focus incident RF energy onto a rectenna.
Figure 9C:
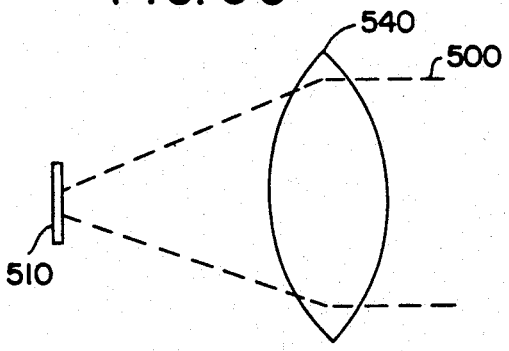
FIG. 9C shows the use of a focusing lens to refract incident RF energy onto a rectenna.
Figure 9D:
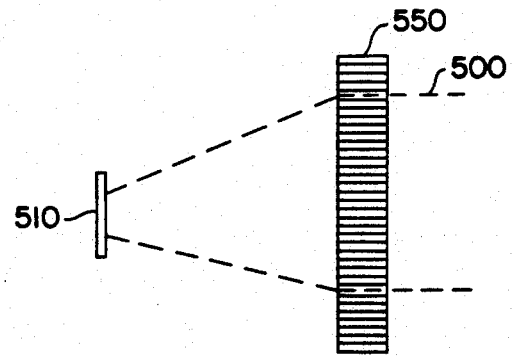
FIG. 9D shows a waveguide phasing array consisting of multiple waveguides with various phases set to focus incident RF energy onto a rectenna.

FIGS. 9A through 9D show methods to distribute incident RF energy 500 to the rectenna array 510. These methods offer the advantage of keeping the incident power level at the antenna constant and optimize performance of the rectenna array at various power levels. FIG. 9A shows use of a parabolic reflector 520 to focus incident RF energy 500 onto rectenna array 510. FIG. 9B shows a cassegrain combination with a parabolic reflector 520A and subreflector 530 to focus incident RF energy 500 onto rectenna array 510. FIG. 9C shows use of a focusing lens 540 to refract incident RF energy 500 onto rectenna array 510. Finally, FIG. 9D shows a waveguide phasing array 550 consisting of multiple waveguides with various phases set to focus incident RF energy 500 onto rectenna array 510.

Figure 10:
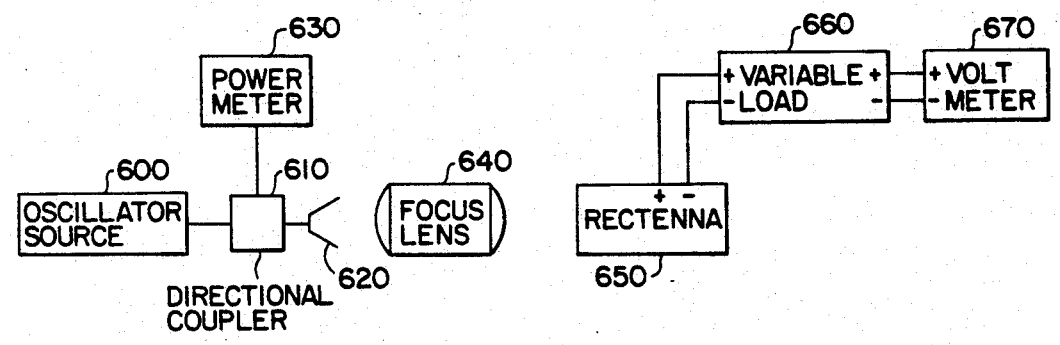
FIG. 10 shows a test set-up for testing individual rectenna structures illustrated in FIG. 8A.

Single rectenna elements of type illustrated in FIGS. 8A and 8B have been tested using a test set-up illustrated in FIG. 10. The test set-up includes an RF source 600 (Millitech GDM Dual Gun Oscillator) operating at a frequency of 35 GHz at 500 mW, that is coupled to a horn 620 via a directional coupler 610. The directional coupler 610 is also connected to a power meter 630 in order to monitor the power output of the source 600. The horn 620 directs the generated RF energy to a spot focusing lens 640 (Millitech GOA 6-inch) which in turn focuses the RF energy on the rectenna array 650 to be tested. The rectenna array 650 is located from the spot focusing lens antenna at a distance equal to the diameter of the spot focusing lens 640. A variable load box 660 is connected to the output of the rectenna array 650 in order to optimize the rectenna array efficiency. A voltage meter 670 is coupled to the output of the variable load box.

Figure 11A:
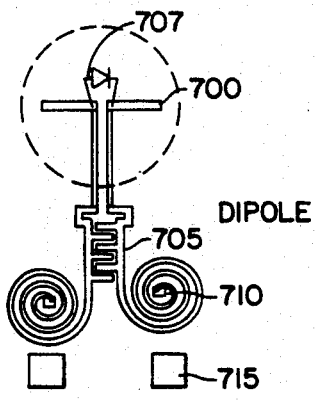
FIG. 11A illustrates the test configuration for a dipole antenna.
Figure 11B:
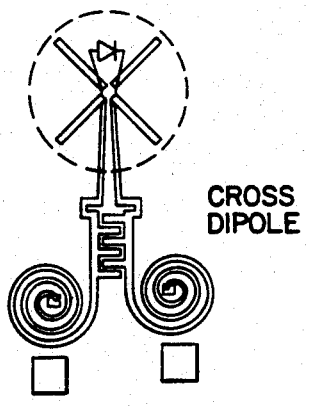
FIG. 11B illustrates the test configuration for a cross dipole antenna.
Figure 11C:
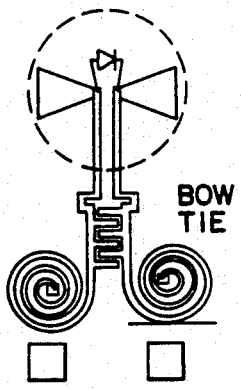
FIG. 11C illustrates the test configuration for a bow tie antenna.
Figure 11D:
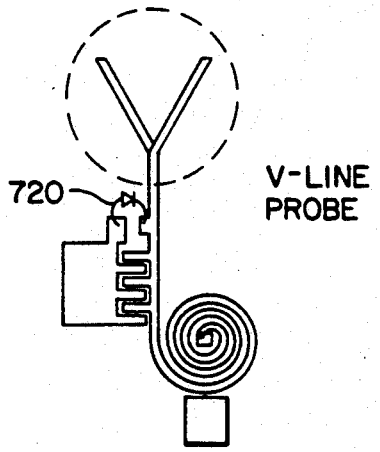
FIG. 11D illustrates the test configuration for a V-line probe antenna.
Figure 11E:
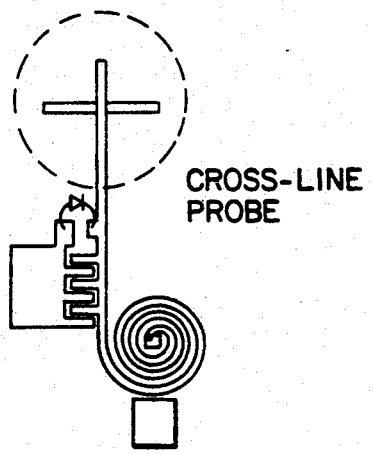
FIG. 11E illustrates the test configuration for a cross-line probe antenna.
Figure 11F:
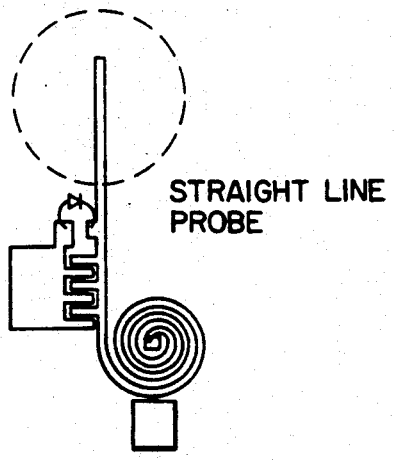
FIG. 11F illustrates the test configuration for a straight line probe antenna.
Figure 11G:
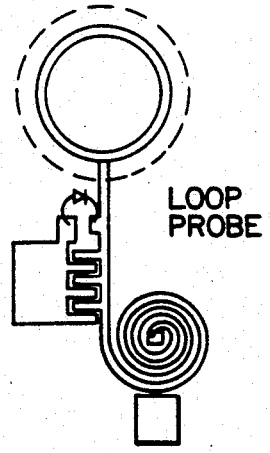
FIG. 11G illustrates the test configuration for a loop probe antenna.

Rectenna array elements of the type illustrated in FIG. 8B have been tested in various configurations. FIGS. 11A–11G show the different antenna elements tested, and the test configuration used. Referring to FIG. 11A the test configuration of a dipole antenna also described in FIG. 8B is shown. The dipole 700 is connected to a low pass filter and DC bus configuration 705. Diode 707 is connected to the antenna. A spiral center contact 710 on the low pass filter 705 is used to wire bond to DC contact 715 so that electrical testing can be performed. A cross dipole test configuration is shown in FIG. 11B, and a Bow Tie in FIG. 11C. FIG. 11D shows a V-line probe, FIG. 11E a cross-line probe, FIG. 11F a straight line probe, and FIG. 11G a loop probe. Note the diode in the structures 11D through 11G as illustrated are connected ½ wavelength from the antenna center.

Rectenna elements shown in FIGS. 11A–11G were tested using various loads, cavity diameters, and cavity heights. Table 1 shows the test results of the various test configurations. The illustrated results are not indicative of relative efficiencies as the test configurations have not been optimized.

It will be readily understood that variations and modifications may be made within the spirit and scope of the invention as expressed in the appended claims, and that the invention is not limited to the specific forms illustrated above. For example, monolithic microwave integrated circuit (MMIC) technology can be used to fabricate top layer 100 and insulating layer 100. The top layer 400 could consist of gallium arsenide with conductive coating 220 deposited on one side, and the diodes, 320, antennas 310, and feed lines 330 deposited on the other. Insulating layer 400 would be the final deposited material. The resonating cavity structure 450 could be included using either monolithic technology, or bonded to the surface of the insulating layer 400 to create a hybrid microwave integrated circuit (HMIC).

TABLE 1

| RECTENNA TYPE | LOAD (OHMS) | CAVITY DIAMETER (IN) | CAVITY HEIGHT (IN) | $P_{out}$ (mW) |
|---|---|---|---|---|
| DIPOLE | 50 | 1/6 | ¼ | 28.0 |
| DIPOLE WITH FOCUS ELEMENT | 50 | ¼ | ¼ | 13.0 |
| DIPOLE | 185 | ¼ | ¼ | 17.5 |
| DIPOLE | 150 | 3/16 | ¼ | 16.2 |
| DIPOLE | 150 | 7/32 | ¼ | 14.0 |
| DIPOLE | 150 | ¼ | ¼ | 12.7 |
| DIPOLE | 150 | ¼ | ¼ | 1.7 |
| CROSS DIPOLE | 100 | ¼ | ¼ | 40.0 |
| BOW TIE | 50 | ¼ | ¼ | 24.0 |
| V-LINE PROBE | 50 | ¼ | ¼ | 3.5 |
| CROSS-LINE PROBE | 50 | ¼ | ¼ | 0.3 |
| STRAIGHT-LINE PROBE | 50 | ¼ | ¼ | 3.0 |
| LOOP PROBE | 50 | ¼ | ¼ | 28.8 |
| LOOP PROBE | 50 | 7/32 | ¼ | 20.0 |

What is claimed is:

1. A rectenna array including at least one rectenna structure, comprising:

a.) a top layer containing a top and bottom surface on which conductive coating is deposited, said bottom surface conductive coating being deposited to form an antenna, and said top surface conductive coating being formed to include a hole to allow RF energy to pass to said antenna;

b.) a diode connected to said antenna; and c.) a resonating cavity structure containing at least one resonating cavity, wherein said resonating cavity structure is located adjacent said bottom surface and said resonating cavity is aligned with said hole in said top surface.

2. A rectenna array as claimed in claim 1, wherein said resonating cavity structure comprises a cavity substrate made of a conductive material.

3. A rectenna array as claimed in claim 1, wherein said resonating cavity structure comprises a cavity substrate having said resonating cavity formed therein, and a conductive coating applied over substantially the entire surface of said resonating cavity.

4. A rectenna array as claimed in claim 1, wherein said resonating cavity structure comprises a cavity substrate top connected to a cavity substrate bottom.

5. A rectenna array as claimed in claim 1, wherein an insulating layer is provided between said top layer and said resonating cavity structure.

6. A rectenna array as claimed in claim 1, wherein said resonating cavity structure comprises a resonating canister attached to said top layer.

7. A rectenna array as claimed in claim 1, wherein said antenna comprises a single dipole to receive linearly polarized RF energy.

8. A rectenna array as claimed in claim 1, wherein said antenna comprises a cross dipole to receive circularly polarized RF energy.

9. A rectenna array as claimed in claim 1, wherein said antenna comprises a bow tie antenna.

10. A rectenna array as claimed in claim 1, wherein said antenna comprises a V-line probe.

11. A rectenna array as claimed in claim 1, wherein said antenna comprises a cross-line probe.

12. A rectenna array as claimed in claim 1, wherein said antenna comprises a straight line probe.

13. A rectenna array as claimed in claim 1, wherein said antenna comprises a loop probe.

14. A rectenna array including at least one rectenna structure, comprising:

a) a top layer containing a top and bottom surface on which conductive coating is deposited, said bottom surface conductive coating being deposited to form an antenna, and said top surface conductive coating being formed to include a hole to allow RF energy to pass to said antenna;

b) a diode connected to said antenna; and c) a resonating cavity structure containing at least one resonating cavity, wherein said resonating cavity structure is located adjacent said bottom surface and said resonating cavity is aligned with said hole in said top surface, and wherein said top layer includes a focus element formed within said hole.

15. A rectenna array as claimed in claim 14, wherein a feed line connected to the antenna forms a low pass filter and DC bus.

16. A rectenna array including at least one rectenna structure, comprising:

a) a top layer containing a top and bottom surface on which conductive coating is deposited, said bottom surface conductive coating being deposited to form an antenna, and said top surface conductive coating being formed to include a hole to allow RF energy to pass to said antenna;

b) a diode connected to said antenna; and c) a resonating cavity structure containing at least one resonating cavity, wherein said resonating cavity structure is located adjacent said bottom surface and said resonating cavity is aligned with said hole in said top surface, and wherein said resonating cavity structure further comprises a resonating canister attached to said top layer, said canister having no surrounding lower substrate.

* * * * *